US005619960A

United States Patent [19]

Funk

[11] Patent Number: 5,619,960

[45] Date of Patent: Apr. 15, 1997

[54] SPACING BLOCK

[76] Inventor: Tyler C. Funk, P.O. Box 1043, Santa Ynez, Calif. 93460

[21] Appl. No.: 618,123

[22] Filed: Mar. 19, 1996

[51] Int. Cl.[6] ..... F02M 31/00

[52] U.S. Cl. ..... 123/184.46

[58] Field of Search ..... 123/184.32, 184.39, 123/184.46

[56] References Cited

U.S. PATENT DOCUMENTS

| | | | |
|---|---|---|---|
| Re. 27,378 | 5/1972 | Lohn | 123/184.46 |
| 2,966,150 | 12/1960 | Wiltshire et al. | 123/184.46 |
| 3,872,845 | 3/1975 | Schultz | 123/668 |
| 4,167,166 | 9/1979 | Varner et al. | 123/543 |
| 4,257,384 | 3/1981 | Matsumoto | 123/184.39 |
| 4,415,507 | 11/1983 | Voliva | 123/184.211 |
| 4,569,322 | 2/1986 | Gristina | 123/547 |
| 5,447,129 | 9/1995 | Kawasaki et al. | 123/184.46 |

FOREIGN PATENT DOCUMENTS

| | | | |
|---|---|---|---|
| 2742616 | 3/1979 | Germany | 123/184.46 |

*Primary Examiner*—David A. Okonsky

[57] ABSTRACT

The present invention relates to a spacing device which is adapted to be interconnected to the intake manifold of an internal combustion engine. This device acts to increase the distance incoming air travels before it enriches the fuel mixture. This increased distance effects higher air velocity and turbulence. This, in turn, creates a more oxygenated fuel supply. The present invention is also described in terms of a kit which enables retrofitting the device upon an existing intake manifold.

1 Claim, 3 Drawing Sheets

SPACING BLOCK

BACKGROUND OF THE INVENTION

1. Field of the Invention

The present invention relates to spacing block and more particularly pertains to a kit for increasing gas milage.

2. Description of the Prior Art

The use of spacer plates is known in the prior art. More specifically, spacer plates heretofore devised and utilized for the purpose of spacer plates are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,415,507 to Volira discloses a mixing valve for a fual fuel carburetor. U.S. Pat. No. 4,215,663 to Gaylord discloses an air fuel inlet device for an internal combustion engine. U.S. Pat. No. 4,667,648 to Beldin discloses a vaporizing assembly. U.S. Pat. No. 4,043,306 to Abbott discloses a carburetor spacer plate with a vapor fuel inlet. Lastly, U.S. Pat. No. 4,086,899 to Gaylord discloses an air fuel inlet device for an internal combustion engine.

In this respect, the spacing block according to the present invention substantially departs from the conventional concepts and designs of the prior art, and in doing so provides an apparatus primarily developed for the purpose of increasing gas milage.

Therefore, it can be appreciated that there exists a continuing need for new and improved spacing block which can be used for increasing gas milage. In this regard, the present invention substantially fulfills this need.

SUMMARY OF THE INVENTION

In view of the foregoing disadvantages inherent in the known types of spacing plates now present in the prior art, the present invention provides an improved spacing block. As such, the general purpose of the present invention, which will be described subsequently in greater detail, is to provide a new and improved spacing block and method which has all the advantages of the prior art and none of the disadvantages.

To attain this, the present invention essentially comprises a spacing block kit which is adapted to increase the distance between the intake manifold and the throttle body injection unit of an internal combustion engine. The spacing block kit includes a lower gasket formed of a resilient material. This gasket includes a lower surface, an upper surface and a peripheral edge therebetween. The peripheral edge has a rearward arcuate portion and a forward linear portion and three circular mounting holes formed about its periphery. A first circular intake aperture is formed through the gasket, and a second circular intake aperture is also formed through the gasket. The lower surface of this gasket is adapted to be positioned upon the intake manifold of an internal combustion engine. The kit further includes an aluminum spacing block having a thickness of approximately 1.25". This spacing block has a lower surface, an upper surface and a peripheral edge which extends therebetween. The peripheral edge has an arcuate rearward portion and a linear forward portion. Three circular mounting holes are formed through the spacing block about its periphery. A first circular intake aperture is formed through the block, and a second circular intake aperture is also formed through the block. The lower surface of the block is adapted to be positioned upon the upper surface of the lower gasket such that the mounting holes and intake apertures of the gasket are in alignment with the mounting holes and intake apertures of the block. The upper gasket is formed of a resilient material. This gasket has a lower surface, an upper surface with a peripheral edge extending therebetween. The peripheral edge has a rearward arcuate portion and a forward linear portion. Three circular mounting holes are formed about the periphery of this gasket. Additionally, a first circular intake aperture is formed through the gasket, and a second circular intake aperture is formed through the gasket. The lower surface of the gasket is adapted to be positioned upon the upper surface of the block such that mounting holes and intake apertures of the gasket are in registration with the mounting holes and intake apertures of the block. A throttle body injection unit, which includes a lower surface which is adapted to be positioned upon the upper surface of the upper gasket, is adapted to be raised by the kit of the present invention. The throttle body includes three mounting holes by which it is interconnected to the intake manifold. Lastly, the kit includes three bolt and washer assemblies. Each of these assemblies is adapted to be positioned within one of the mounting holes of the lower gasket, block, upper gasket and throttle body injection unit. Thus, the three bolt and washer assemblies are adapted to secure the lower gasket, block, upper gasket and throttle body injection unit to the intake manifold of an internal combustion engine.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved spacing block which have all the advantages of the prior art spacing plates and none of the disadvantages.

It is another object of the present invention to provide new and improved spacing block which may be easily and efficiently manufactured and marketed.

it is further object of the present invention to provide new and improved spacing block which are of durable and reliable constructions.

An even further object of the present invention is to provide new and improved spacing block which are susceptible of a low cost of manufacture with regard to both materials and labor, and which accordingly are then susceptible of low prices of sale to the consuming public, thereby making such spacing block economically available to the buying public.

Still yet another object of the present invention is to provide new and improved spacing block which provide in the apparatuses and methods of the prior art some of the advantages thereof, while simultaneously overcoming some of the disadvantages normally associated therewith.

Even still another object of the present invention is to employ a spacing block to increase gas milage.

Lastly, it is an object of the present invention to provide new and improved spacing device which is adapted to be interconnected to the intake manifold of an internal combustion engine. This device acts to increase the distance incoming air travels before it enriches the fuel mixture. This increased distance effects higher air velocity and turbulence. This, in turn, creates a more oxygenated fuel supply. The present invention is also described in terms of a kit which enables retrofitting the device upon an existing intake manifold.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
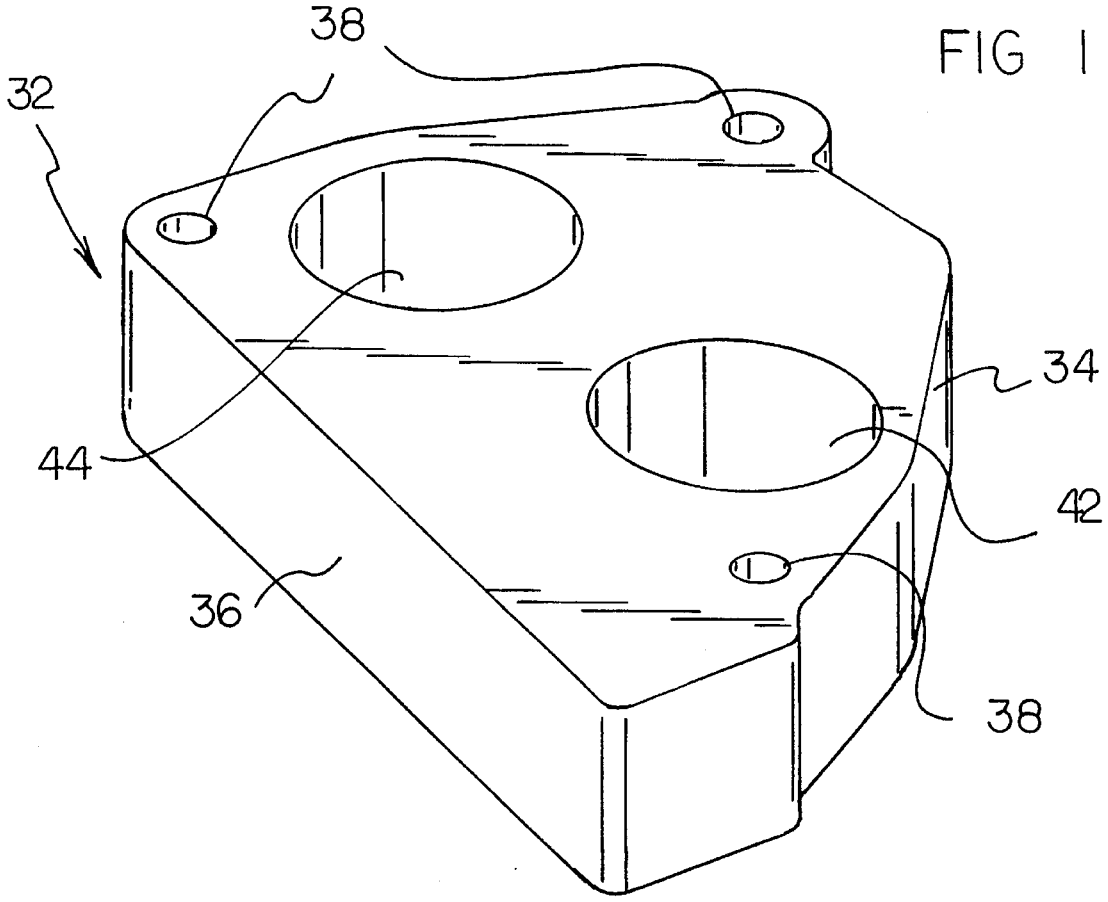
FIG. 1 is a perspective view of the preferred embodiment of the spacing block constructed in accordance with the principles of the present invention.
Figure 2:
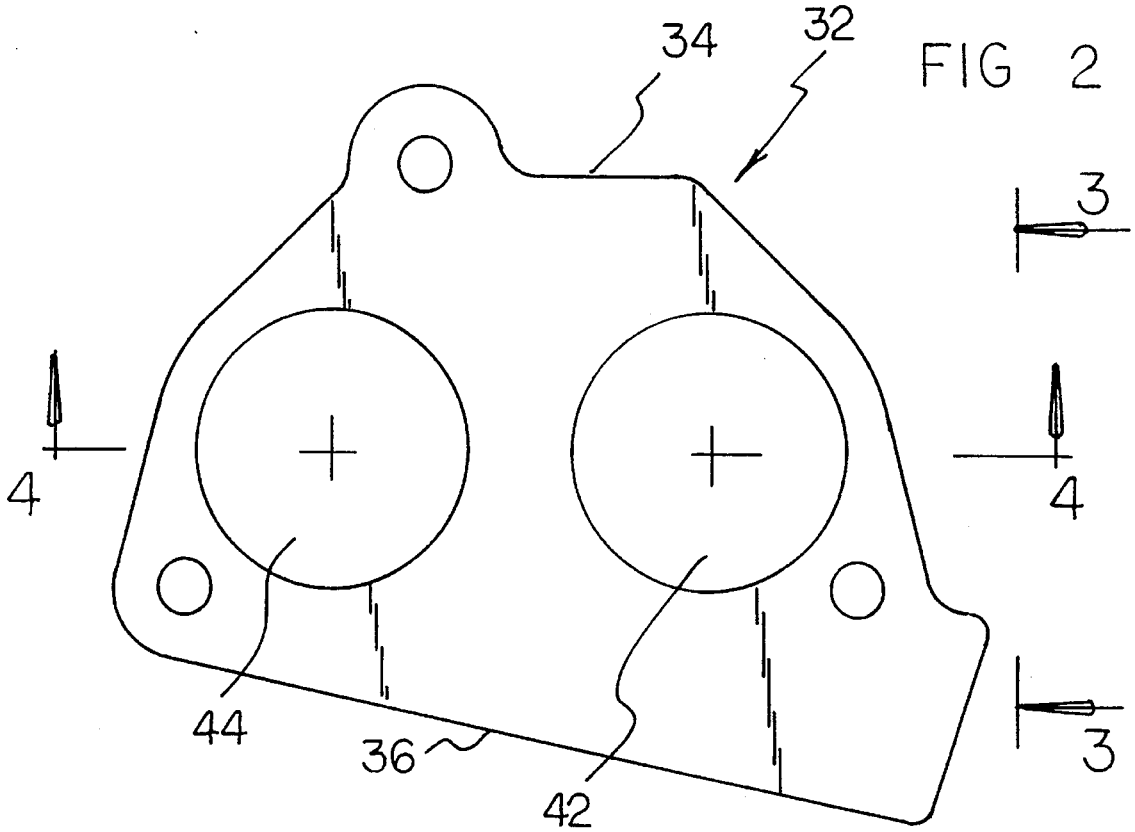
FIG. 2 is a plan view of the spacing block in accordance with the present invention.
Figure 3:
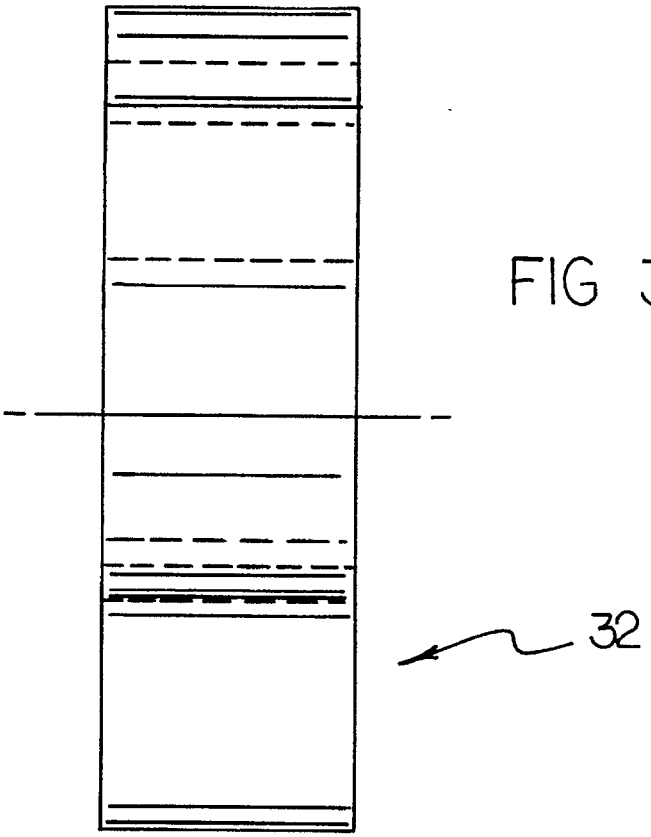
FIG. 3 is a view of the spacing block taken along line 3—3 of FIG. 3.
Figure 4:
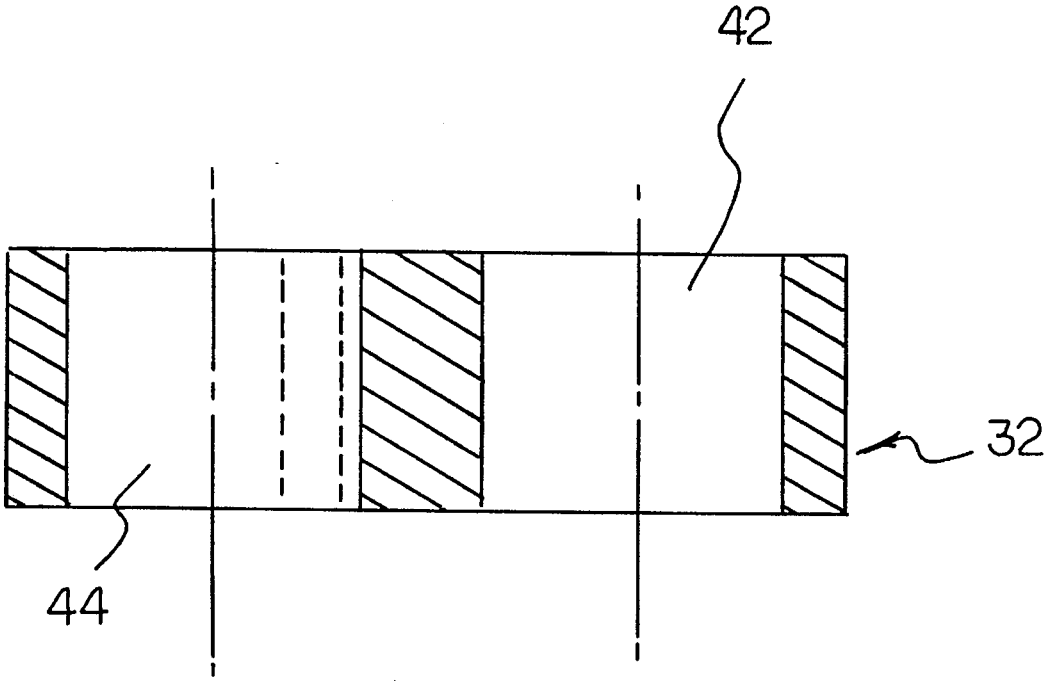
FIG. 4 is a view of the spacing block taken along line 4—4 of FIG. 2.

With reference now to the drawings, and in particular to FIG. 1 thereof, the preferred embodiment of the new and improved spacing block embodying the principles and concepts of the present invention and generally designated by the reference numeral 10 will be described.

The present invention relates to a spacing device which is adapted to be interconnected to the intake manifold of an internal combustion engine. This device acts to increase the distance incoming air travels before it enriches the fuel mixture. This increased distance effects higher air velocity and turbulence. This, in turn, creates a more oxygenated fuel supply. The present invention is also described in terms of a kit which enables retrofitting the device upon an existing intake manifold. The various components of the present invention, and the manner in which they interrelate, will be described in greater detail hereinafter.

The spacing block kit of the present invention is adapted to increase the distance between the intake manifold and the throttle body injection unit of an internal combustion engine. This kit includes the following: a lower gasket; a spacing block; an upper gasket; and a set of mounting screws and washers.

Figure 5:
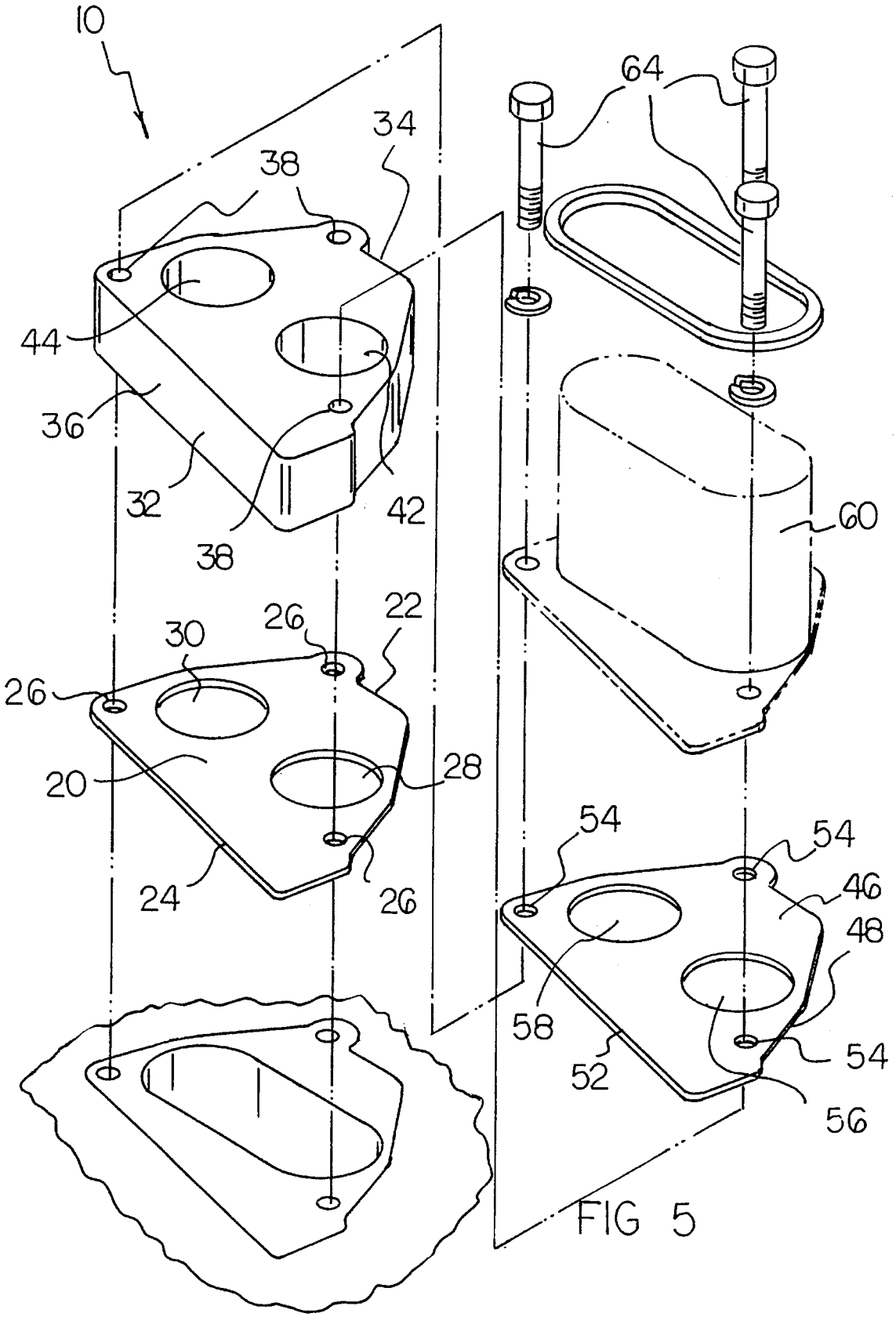
FIG. 5 is an exploded view of the block, gaskets and throttle body injection unit in accordance with the present invention.

The lower gasket 20 is formed of a resilient material, with a natural or synthetic rubber being the preferred material. The gasket is partly defined by a lower surface, an upper surface and a peripheral edge which extends therebetween. This peripheral edge includes a rearward arcuate portion 22 and a forward linear portion 24. The general outline of the lower gasket 20 can most clearly be seen with reference to FIG. 5. Three circular mounting holes 26 are formed about the periphery of the gasket and are utilized in securing the gasket to both the intake manifold and the other kit components. Furthermore, first and second circular intake apertures 28 and 30 are formed through the gasket. The lower surface of the gasket is adapted to be positioned upon the intake manifold of an internal combustion engine.

The next component in the kit is the spacing block 32. In the preferred embodiment the block is constructed from billeted aluminum has a thickness of approximately 1.25". Additionally, in the preferred embodiment the block 32 has a length of 6" and a width of 4.5". The spacing block 32 is defined by a lower surface, an upper surface and a peripheral edge which extends therebetween. As with the lower gasket 20, the peripheral edge has an arcuate rearward portion 34 and a linear forward portion 36. Three circular mounting holes 38 are formed through the spacing block 32 about the periphery. These mounting holes 38 are adapted for registration with the mounting holes of the other kit components. In the preferred embodiment all of the mounting holes of the kit components are 5/16" in diameter. Additionally, first and second circular intake apertures 42 and 44 are formed through the block 32. In the preferred embodiment, these intake apertures have a diameter of 1.75". In an alternative embodiment, the intake apertures 42 and 44 of the block 32 are tapered inwardly from the upper surface of the block towards the lower surface of the block 32. Thus, in this embodiment the intake apertures 56 and 58 of the upper gasket 46 are slightly larger than the intake apertures 28 and 30 of the lower gasket 20. The lower surface of the block 32 is adapted to be positioned upon the upper surface of the lower gasket 20 such that the mounting holes and intake apertures of the gasket are in alignment with the mounting holes and intake apertures of the block 32. This arrangement can most clearly be seen with reference to FIG. 5.

The next component of the kit is the upper gasket 46. In the preferred embodiment, the upper gasket 46 is constructed from a resilient material such as a natural or synthetic rubber. Additionally, the upper gasket 46 is, in part, defined by a lower surface, an upper surface and a peripheral edge which extends therebetween. The peripheral edge includes a rearward arcuate portion 48 and a forward linear portion 52. These two portions match corresponding portions on both the lower gasket 20 and the spacing block 32. As with the other components, three circular mounting holes 54 are formed about the periphery of the gasket. Furthermore, first and second circular intake apertures 56 and 58 are formed through the gasket. The lower surface of the gasket is adapted to be positioned upon the upper surface of the block 32 such that mounting holes and intake apertures of the gasket are in registration with the mounting holes and intake apertures of the block 32 and lower gasket 20.

When in place, the two gaskets and spacing block 32 serve to raise the throttle body injection unit a distance above the intake manifold. In order to achieve this, the throttle body injection unit 60 has a lower surface which is adapted to be positioned upon the upper surface of the upper gasket 46. Additionally, the throttle body 60 includes three mounting holes 62 which permit the unit to be secured to the various components of the kit. Furthermore, although the present invention has been described in conjunction with a throttle body injection unit 60 it can be utilized in conjunction with any device which is adapted to be positioned over the intake manifold of an internal combustion engine. For example, the present kit can be employed with a more standard carburetor.

The last component of the kit is a set of three bolt and washer assemblies. Each of these assemblies is adapted to be positioned within one of the mounting holes of the lower gasket 20, block 32, upper gasket 46 and throttle body injection unit. Thus, the three bolt and washer assemblies are adapted to secure the lower gasket 20, block 32, upper gasket 46 and throttle body injection unit to the intake manifold of an internal combustion engine. The bolt and washer assemblies can most readily be view with reference to FIG. 5.

Thus, the present invention relates to a spacer which is designed to go underneath the throttle body injection unit on a V6 or V8 engine. It is adapted to fit most GM products. The spacer with raise the throttle body injection unit off the intake above 1.25". This will cause the air flowing through the throttle body injection unit to pick up speed and when it hits the inside bottom of the intake it atomizes the fuel in a more efficient manner. This builds torque, increases gas milage and increases acceleration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spacing block kit which is adapted to increase the distance between the intake manifold and the throttle body injection unit of an internal combustion engine, the spacing block kit comprising, in combination:

a lower gasket formed of a resilient material, the gasket having a lower surface, an upper surface and a peripheral edge therebetween, the peripheral edge having a rearward arcuate portion and a forward linear portion, three circular mounting holes formed about the periphery of the gasket, a first circular intake aperture formed through the gasket, a second circular intake aperture formed through the gasket, the lower surface of the gasket adapted to be positioned upon the intake manifold of an internal combustion engine;

an aluminum spacing block having a thickness of approximately 1.25 inches, the spacing block having a lower surface, an upper surface and a peripheral edge therebetween, the peripheral edge having an arcuate rearward portion and a linear forward portion, three circular mounting holes formed through the spacing block about the periphery, a first circular intake aperture formed through the block, the lower surface of the block adapted to be positioned upon the upper surface of the lower gasket such that the mounting holes and intake apertures of the gasket are in alignment with the mounting holes and intake apertures of the block;

an upper gasket formed of a resilient material, the gasket having a lower surface, an upper surface and a peripheral edge therebetween, the peripheral edge having a rearward arcuate portion and a forward linear portion, three circular mounting holes formed about the periphery of the gasket, a first circular intake aperture formed through the gasket, a second circular intake aperture formed through the gasket, the lower surface of the gasket adapted to be positioned upon the upper surface of the block such that mounting holes and intake apertures of the gasket are in registration with the mounting holes and intake apertures of the block;

a throttle body injection unit having a lower surface which is adapted to be positioned upon the upper surface of the upper gasket, the throttle body having three mounting holes; and three bolt and washer assemblies, each assembly adapted to be positioned within one of the mounting holes of the lower gasket, block, upper gasket and throttle body injection unit, the three bolt and washer assemblies adapted to secure the lower gasket, block, upper gasket and throttle body injection unit to the intake manifold of an internal combustion engine.

* * * * *